US005197737A

United States Patent [19]

Desbiolles et al.

[11] Patent Number: 5,197,737

[45] Date of Patent: Mar. 30, 1993

[54] PUTTER HEAD

[75] Inventors: Jacques Desbiolles, Annecy; Andre Pernelle, Seynod, both of France

[73] Assignee: Taylor Made Golf Company, Carlsbad, Calif.

[21] Appl. No.: 531,052

[22] Filed: May 31, 1990

[30] Foreign Application Priority Data

Jun. 1, 1989 [FR] France ..... 89 07248

[51] Int. Cl.[5] ..... A63B 53/04

[52] U.S. Cl. ..... 273/169; 273/171; 273/173

[58] Field of Search ..... 273/167 R, 167 F, 169, 273/167 H, 172, 173, 167 J, 171, 167 A-167 E, 167 G, 78

[56] References Cited

U.S. PATENT DOCUMENTS

| | | | |
|---|---|---|---|
| D. 228,930 | 10/1973 | Leigh | 273/167 F |
| 2,201,638 | 5/1940 | Theibault, Sr. | 273/167 A |
| 2,530,446 | 11/1950 | Beardsley | 273/168 |
| 2,781,197 | 2/1957 | Wiley | 273/169 |
| 2,846,228 | 8/1958 | Reach | 273/167 F |
| 3,516,674 | 6/1970 | Scarborough | 273/169 |
| 3,695,618 | 10/1972 | Woolley et al. | 273/78 |
| 3,921,984 | 11/1975 | Winter | 273/167 F |
| 3,966,210 | 6/1976 | Rozmus | 273/167 F |
| 3,995,865 | 12/1976 | Cochran et al. | 273/169 |
| 4,121,832 | 10/1978 | Ebbing | 273/171 |
| 4,508,350 | 4/1985 | Duclos | 273/169 |
| 4,632,400 | 12/1986 | Boone | 273/164 |
| 4,778,185 | 10/1988 | Kurokawa | 273/169 |
| 4,979,744 | 12/1990 | Alcala | 273/169 |
| 4,984,800 | 1/1991 | Hamada | 273/173 |

FOREIGN PATENT DOCUMENTS 1297239 11/1972 United Kingdom .

OTHER PUBLICATIONS

A copy of French Search Report and Annex.

*Primary Examiner*—V. Millin
*Assistant Examiner*—Steven B. Wong
*Attorney, Agent, or Firm*—Sandler Greenblum & Bernstein

[57] ABSTRACT

A golf club, particularly a putter, having a head which includes an elongated element affixed to a shell and a method of assembling the golf club. The elongated element includes two laterally spaced masses, a linking portion extending between the two laterally spaced masses and a generally planar front surface constituting a golf ball striking surface. The shell, which is adapted to have a shaft extending therefrom, includes a front portion having an opening for receiving and seating the elongated element, while leaving the generally planar front surface exposed.

40 Claims, 2 Drawing Sheets

Fig- 5
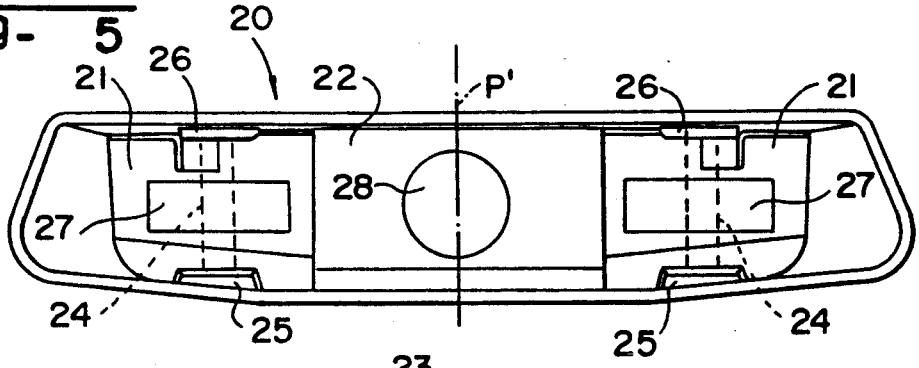
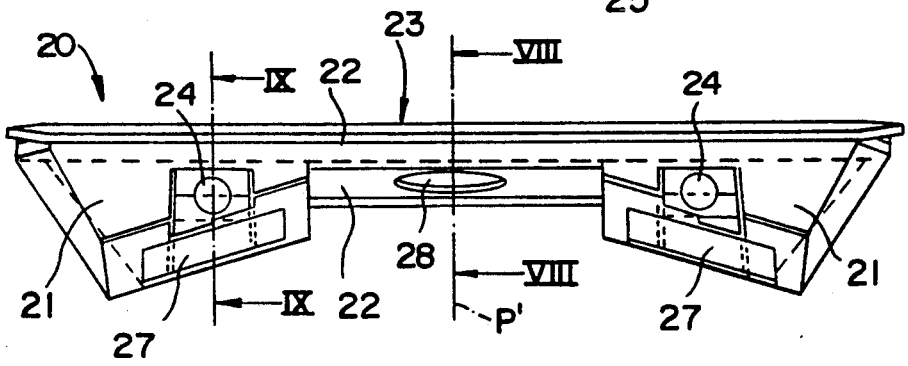
Fig- 6
Fig- 7
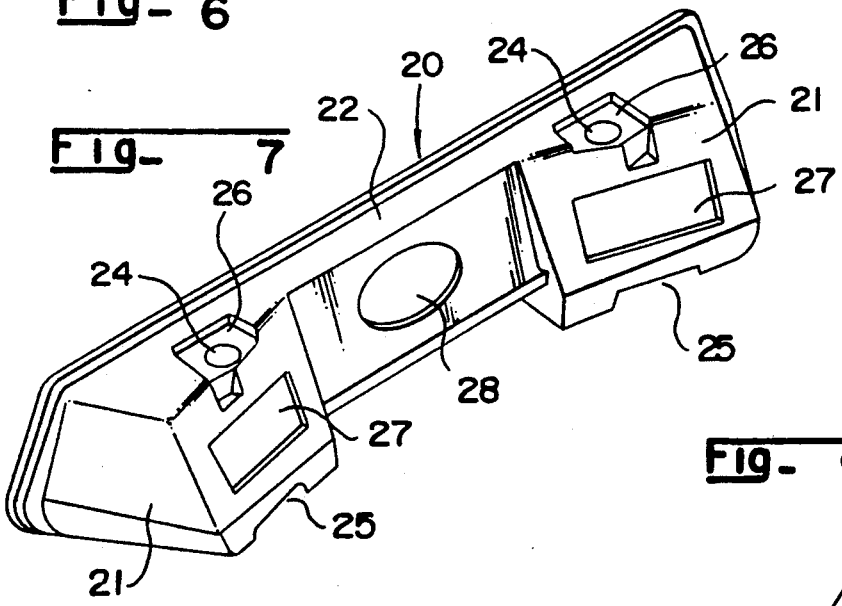
Fig- 9
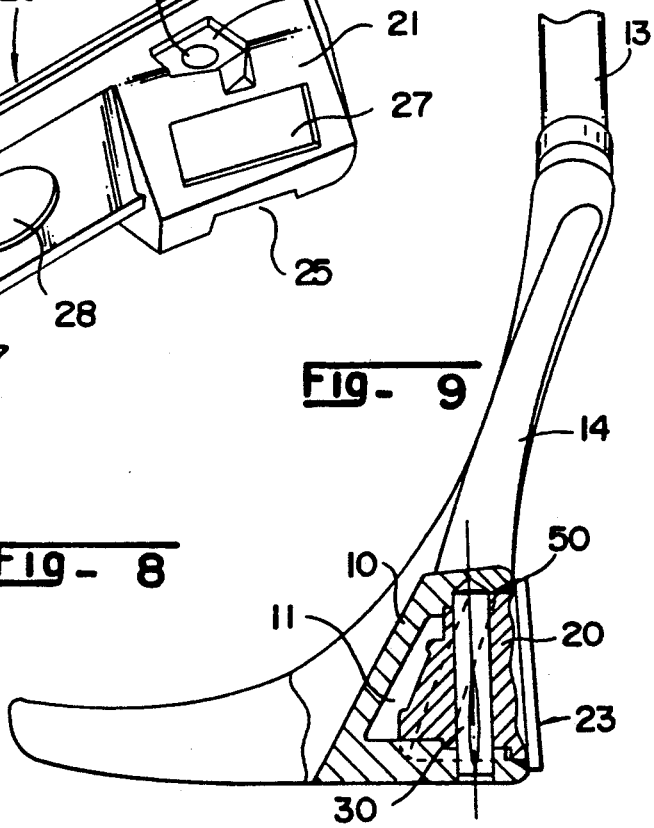
Fig- 8
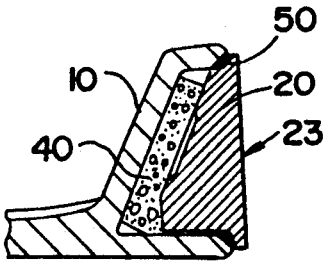

PUTTER HEAD

BACKGROUND OF THE INVENTION

1. Field of the Invention

The present invention relates to a putter, i.e., a particular golf club designed for striking a golf ball toward the hole, particularly after the golfer has played the ball to the green, and is a relatively short distance from the hole.

More particularly, the present invention relates to a putter, known as an "inertial" putter, i.e., one whose major portion of the mass of the head thereof is distributed at the point and the heel, i.e., the ends of the elongated hitting face of the putter. By virtue of such a mass distribution, for a given total mass, the moment of inertia of the putter is substantially increased, which substantially reduces the risk of rotation and of improper inclination of the head during the striking of the ball.

2. Description of Background and Other Information

Known putters of the type described are generally formed either as a single piece, made of molded or forged steel mounted at the end of a shaft or, as disclosed in U.S. Pat. No. 2,781,971, for example, as two metallic masses which are enclosed or molded into a shell made of synthetic material which receives, and has affixed thereto, a metallic hitting surface, the shell being mounted at the end of the shaft of the golf club.

These known putter heads have a certain number of disadvantages. For example, putter heads formed as a single mass of steel, whether molded or forged, do not allow for anything but a relatively limited variation in shape. Generally, putter heads which have a synthetic shell are more complex to produce, particularly by virtue of the fact that the surface must be affixed to the shell with precision to ensure that the surface is both precisely and durably mounted.

SUMMARY OF THE INVENTION

It is therefore an object of the present invention to provide a golf club which includes:

(a) an element having at least two lateral portions and a front surface constituting a golf ball striking surface, wherein the mass of the element is distributed substantially more greatly in the two lateral portions;

(b) a shell adapted to have a shaft extending therefrom, the shell having a front portion, the front portion of the shell having an opening for receiving and seating the element, while leaving the front surface exposed; and (c) means for affixing the element to the shell.

In a particular aspect of the invention, each of the two lateral portions are formed in a shape which tapers in a direction toward each other.

Further, according to another aspect of the invention, each of the two lateral portions are formed in a shape which tapers downwardly.

In one embodiment of the invention, the element is made as a unitary piece.

In an alternative embodiment, the element is made as an assembly of three pieces, two of the pieces being constituted by the two lateral portions, and the third piece being constituted by a piece linking the two lateral portions, the linking piece including the generally planar surface which constitutes the surface which is used for striking the golf ball.

A filling material can be located within the shell and rearward of the element, according to a further aspect of the invention.

According to a specific feature of the invention, the means for affixing the element to the shell include coaxial bores formed within the element and the shell and at least one dowel fitted within the coaxial bores.

Further according to this aspect of the invention, the coaxial bores include a bore formed in each of the lateral portions, and a dowel is fitted within each of the bores.

Still further according to the invention, the means for affixing the element to the shell further includes means for centering the element relative to the shell.

More specifically, each of the lateral portions have recesses through which the coaxial bores extend, the shell includes bosses through which corresponding ones of the coaxial bores extend, and the means for centering the element relative to the shell includes the bosses of the shell mating with respective ones of the recesses of the element as the element is affixed to the shell.

According to another feature of the invention, each of the element and the shell have respective peripheries and a peripheral joint is interposed between the respective peripheries, whereby the elongated element and the shell are joined together.

More specifically, the golf club of the present invention is a putter head which includes:

(a) an elongated element including:
  (i) two laterally spaced masses;
  (ii) a linking portion extending between the two laterally spaced masses; and
  (iii) a generally planar front surface constituting a golf ball striking surface;

(b) a shell adapted to have a shaft extending therefrom, the shell having a front portion, the front portion of the shell having an opening for receiving and seating the elongated element, while leaving the generally planar front surface exposed; and (c) means for affixing the elongated element to the shell.

In a specific embodiment of the invention, the elongated element is made from sintered steel.

Still further, the elongated element further includes a quantity of a metal denser than the sintered steel which has been migrated to the sintered steel by heating.

Still further, the elongated element includes a plurality of compartments for receiving the quantity of metal.

The present invention is also directed to a method of assembling a putter and putter head in which the head includes affixing the elongated element to the shell within the opening of the shell, leaving the generally planar front surface exposed.

The method of the present invention further includes, prior to the step of affixing the elongated element to the shell, the step of inserting a filling material within the shell.

Still further according to the method of the invention, the elongated element further includes coaxial bores formed within the elongated element and the shell, and wherein the step of affixing the elongated element to the shell includes fitting at least one dowel within the coaxial bores.

Still further according to the method of the invention, the coaxial bores include a transverse bore formed in each of the laterally spaced masses, and wherein the step of affixing the elongated element to the shell further includes fitting a dowel within each of the bores.

The method of the invention further includes the step of affixing the elongated element to the shell includes joining the respective peripheries together.

The step of affixing the elongated element to the shell includes centering the elongated element relative to the shell.

Further, in the embodiment in which the elongated element is made from sintered steel, the method further includes, prior to the step of affixing the elongated element to the shell includes adding a quantity of a metal denser than the sintered steel to the elongated element, and heating the elongated element and added quantity of metal.

Further according to this embodiment, the elongated element includes a plurality of compartments for receiving the quantity of metal, and the step of adding a quantity of a metal denser than the sintered steel to the elongated element includes adding a quantity of the metal to each of the compartments.

Lastly, the method of the invention includes the step of affixing a shaft to the shell.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIG. 5 is a rear elevation view of the elongated element;

FIG. 6 is a plan view of the elongated element;

FIG. 7 is a perspective view of the elongated element;

FIG. 8 is a cross-sectional elevation view of the putter head of the invention, taken along line VIII—VIII of FIG. 6, after the shell and the elongated element are assembled; and FIG. 9 is a cross-sectional elevation view of the putter, taken along line IX—IX of FIG. 6, after the shell and the elongated element are assembled.

DETAILED DESCRIPTION OF PREFERRED EMBODIMENTS

Figure 1:
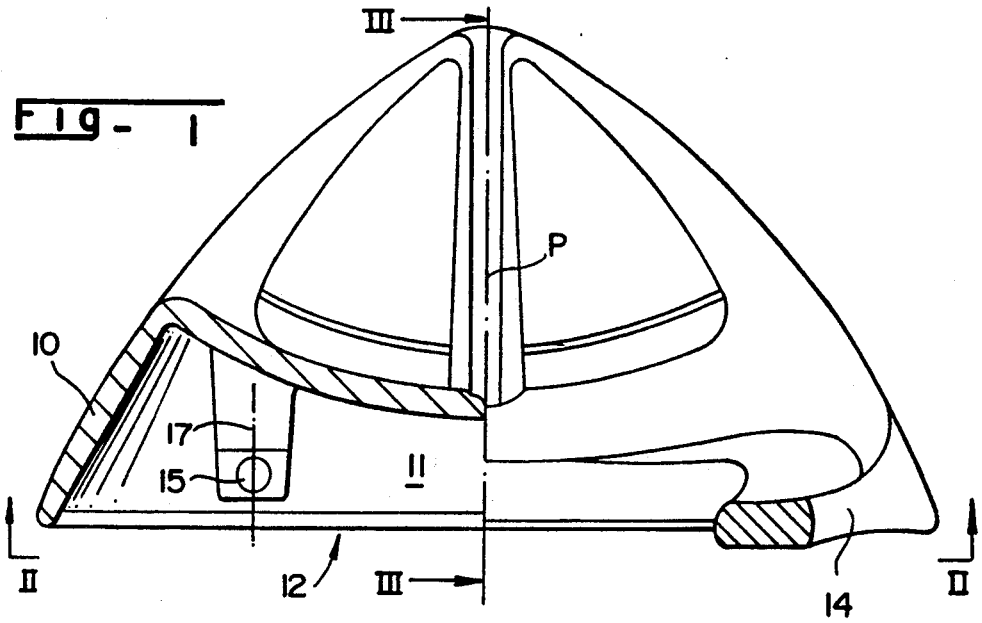
FIG. 1 is a plan view, partially in cross-section, taken along line I—I of FIG. 2, of the shell of the putter head of the invention.
Figure 3:
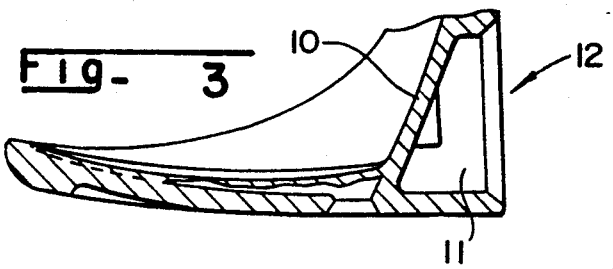
FIG. 3 is a cross-sectional elevation view of the shell, taken along line III—III of FIG. 1.

The putter head of the present invention overcomes the disadvantages inherent in known putter heads, as described above. In particular, the putter head of the present invention maintains the advantages which do exist for putter heads made from a synthetic material, while also being extremely easy to produce.

To this end, the putter head of the present invention includes a laterally elongated element comprising two laterally spaced masses connected by a central linking portion. The front surface of the elongated element constitutes, over the majority of its length, the hitting surface of the putter. Further, the putter head includes an exterior shell being open at the front in a manner so as to receive and seat the elongated element, while leaving the hitting surface of the elongated element exposed, after the elongated element is seated. Means are also provided for affixing the elongated element to the shell.

According to various preferred embodiments:

- the two masses are laterally spaced apart and, preferably, are equally positioned from top to bottom;
- the elongated element can be made from a single piece or by affixing three pieces, two of the pieces constituting the lateral masses and the third of the pieces constituting the central linkage portion and the hitting surface of the club;
- situated in the rear of the elongated element is a material which surrounds or fills the internal volume of the shell;
- the means for affixing the elongated element to the shell includes a connecting plug, or dowel, which is forcefitted in coaxial bores formed both in the elongated element and in the shell, the bores formed in the elongated element preferably being in the form of a transverse bore formed in each of the lateral masses;
- a peripheral joint is interposed between the elongated element and the shell on the periphery of their contact zone;
- means are provided for properly positioning the elongated element and the shell before the assembly of the two parts;
- the elongated element is made from sintered steel, the density of the sintered steel of the elongated element then being advantageously increased by applying to the elongated element a portion of the metal which is more dense, and migrating this metal by heating the assembly, the elongated element comprising compartments for receiving portions of the dense metal.

With reference to the drawing, the putter head of the invention includes an exterior shell 10, illustrated in FIGS. 1–4, and an element 20 which receives laterally spaced masses, illustrated in FIGS. 5–7.

The shell 10 is an element which is molded, for example, from a synthetic material or from a metal alloy. The shell has a cavity 11 which is open at a lower portion 12 (which is located at the front portion of the putter which will strike the ball). The shell is connected to the shaft 13 by means of a linkage connection 14.

The shell 10 has a general plane of symmetry P, shown in FIGS. 1 and 2, and which will be assumed to be vertical in the following description. Further, the shaft 13 extends along axis $\delta$ at an angle with respect to plane P and which intersects with plane P at a point X within the shell 10, as shown in FIG. 2.

Figure 2:
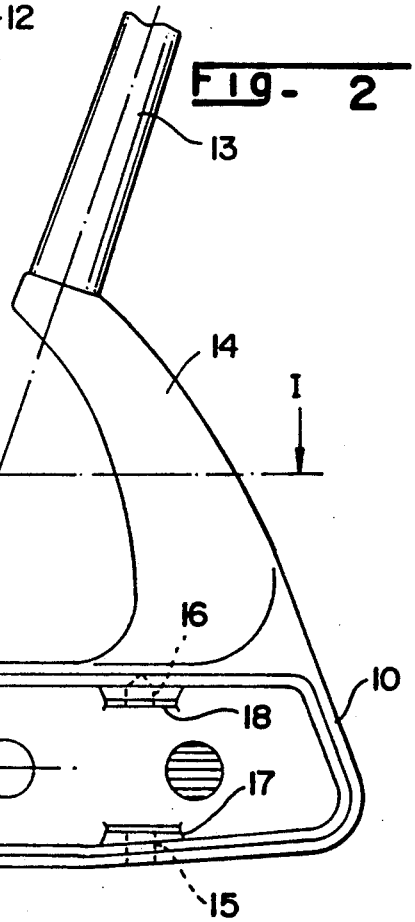
FIG. 2 is a front elevation view of the shell, taken along line II—II of FIG. 1.
Figure 4:
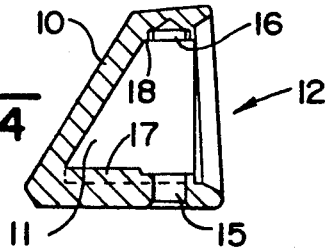
FIG. 4 is a cross-sectional elevation view of the shell, taken along line IV—IV of FIG. 2.
Figure 4:
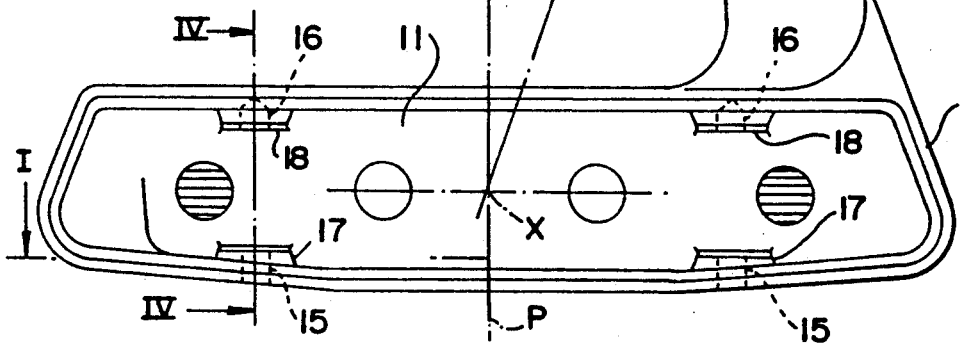

As seen in FIG. 2, for example, the shell 10 includes two vertical bores 15 on either lateral side of a lower wall (with reference to a general orientation corresponding to an impact position of the club with a ball) which correspond and are aligned, respectively, with two vertical bores 16 on either lateral side of an upper wall.

Each of the bores 15, 16 is formed in a boss 17, 18, respectively, on the interior of the shell 10.

The opening 11 formed in the shell 10 receives the elongated element 20, as illustrated in FIGS. 5–7, the final assembly of the putter head being illustrated in cross-section in FIGS. 8 and 9.

The element 20 is formed to include two laterally offset masses 21, which are connected by a central linkage portion 22. The assembly of masses 21 and portion 22 is symmetrical with respect to a vertical plane of symmetry P', shown in FIGS. 5 and 6, which coincides with the plane of symmetry P of the shell 10 and on both sides of which the masses 21 are positioned.

This configuration permits, for the single total mass of the elongated element 20, to obtain a greater moment of inertia, which prevents undesirable rotation of the putter at the moment of contact of the putter head with the ball.

When the two lateral masses 21 are viewed in the plan view of FIG. 6, or in a horizontal cross-sectional plane, they are seen to be made in a shape which tapers in a direction along the plane P' and are spaced apart such that the centers of gravity of the masses 21 are spaced as far apart as possible from the plane of symmetry P'. In other words, each of the masses has a width dimension which increases in a direction away from the plane of symmetry.

Furthermore, when the two lateral masses 21 are viewed in cross-section through a plane which is parallel to the plane of symmetry P', as shown in FIG. 9, they have a shape which tapers vertically or, in other words, have a depth dimension which increases downwardly, such that their centers of gravity are positioned as low as possible. Thus, each of the two lateral masses 21 has a shape which increases both downwardly and outwardly from the median plane.

According to one characteristic of the invention, the front surface 23 of the elongated element 20 constitutes the striking surface of the putter, as can be seen in particular in FIGS. 8 and 9. In the non-limiting example illustrated, the front surface 23 is approximately planar and approximately vertical when the axis $\delta$ of shaft 13 is held in a vertical plane. If desired, the front surface 23 could be configured so that it is inclined slightly upwardly and rearwardly or, alternatively, slightly upwardly and forwardly. The lateral masses 21 extend to project along a horizontal direction opposite to the front surface 23.

The elongated element 20 can be formed as a single piece, or can be formed as an assembly of three elements, namely, a flat element having a striking surface and including the linking portion 22, and two masses, which correspond to the masses 21 previously described, assembled in a fixed manner to opposite the striking surface.

To permit the rigid connection of the elongated element 20 to the shell 10, as shown in FIGS. 5–7, the masses 20 include two laterally spaced bores 24, which are adapted to be aligned with corresponding bores 15 and 16 of the shell. The bores 24 of the elongated element are located within recessed surfaces 25 and 26, which receive respective bosses 17 and 18, within which the bores 15 and 16, respectively, are located.

The elongated element 20 can be formed from sintered steel, which produces excellent dimensional characteristics, with a relatively low manufacturing cost.

In summary, while sintered steel has a relatively low density, the mass is advantageously increased by a process, itself being known, which comprises placing portions of a relatively dense metal, copper for example, in appropriate compartments such as, for example, compartments 27 and 28, which face one another at the rear of the elongated element 20 and heating the assembly in a furnace, the increase of temperature thus producing a migration of the pure copper into the mass of the elongated element, which increases the final density thereof.

The elongated element thus prepared is mounted in shell 10 in the manner illustrated in the cross-sections of FIGS. 8 and 9. The precise positioning, or centering, of the mass-carrying element 20 in seat 11, which is necessary to obtain an exact geometry of the striking surface 23 with respect to the shaft 13 of the putter, is obtained by the bosses 17, 18 and the respective facing upper and lower recesses 25, 26 which mate as the elongated element is mounted within the shell. It is contemplated, as an alternative to the centering configuration just described, that the bosses could extend from the masses 21 and the cooperating recesses could be located in the shell 10.

A filling 40 can be provided within the interior volume of the shell 10, positioned at the rear of the elongated element 20. The filling 40 can be made, for example, from an elastomeric material or from an expanding synthetic resin, which is also used for the joint 50 which is interposed between the elongated element 20 and the shell 10 on the periphery of their contact zone.

Once the elongated element 20 and the shell 10 are thus positioned, the final assembly is obtained by force fitting a metallic plug 30 within each of the bores 15, 16, to securely and durably affix the different elements of the putter.

Finally, although the invention has been described with reference of particular means, materials and embodiments, it is to be understood that the invention is not limited to the particulars disclosed and extends to all equivalents within the scope of the claims.

What is claimed is:

1. A putter head comprising:

(a) an elongated element having a vertical plane of symmetry, said elongated element comprising:

(i) two laterally spaced masses, each of said two laterally spaced masses comprising a shape having an increasing dimension with respect to a direction normal to and away from said vertical plane of symmetry and a predetermined density;

(ii) a linking portion extending between said two laterally spaced masses; and (iii) a generally planar front surface constituting a golf ball striking surface;

(b) a shell adapted to have a shaft extending therefrom, said shell having a front portion, said front portion of said shell having an opening for receiving and seating said elongated element, while leaving said generally planar front surface exposed, said shell comprising a material having a density lower than said predetermined density of either of said masses, wherein said masses provide an increased moment of inertia for said elongated element so as to prevent undesirable rotation of the putter head at the moment of contact with a golf ball; and (c) means for affixing said elongated element to said shell comprising means for directly securing at least one of (i) said laterally spaced masses and (ii) said linking portion to said shell.

2. The putter head of claim 1, wherein said elongated element is made as a unitary piece.

3. The putter head of claim 1, wherein said elongated element is formed by an assembly of three pieces, consisting of said two laterally spaced masses and said linking portion, wherein said linking portion includes said generally planar front surface.

4. The putter head of claim 1, further comprising a filling material located within said shell and rearward of said elongated element.

5. The putter head of claim 1, wherein said means for affixing said elongated element to said shell include coaxial bores formed within said elongated element and said shell and at least one dowel force-fitting within said coaxial bores.

6. The putter head of claim 5, wherein said coaxial bores comprise a transverse bore formed in each of said laterally spaced masses, and wherein a dowel is force-fitted within each of said bores.

7. The putter head of claim 1, wherein each of said elongated element and said shell have respective peripheries and a peripheral joint interposed between said respective peripheries, whereby said elongated element and said shell are joined together.

8. The putter head of claim 1, wherein said means for affixing said elongated element shell comprises means for centering said elongated element relative to said shell.

9. The putter head of claim 1, wherein said elongated element is made from sintered steel.

10. The putter head of cl aim 9, wherein said elongated element further includes a quantity of a metal denser than said sintered steel which has been migrated to said sintered steel by heating.

11. The putter head of claim 10, wherein said elongated element comprises a plurality of compartments for receiving said quantity of metal.

12. A putter comprising the putter head of claim 1, in combination with said shaft connected to said shell.

13. The putter head of claim 1, said means for directly securing comprising means for directly securing said laterally spaced masses to said shell.

14. The putter head of claim 1, wherein said shell is a formed as a unitary piece having no rearwardly facing opening.

15. The putter head of claim 1, wherein said material of which said shell is comprised is synthetic.

16. A putter head comprising:

(a) an elongated element having a vertical plane of symmetry, said elongated element comprising:
  (i) two laterally spaced masses, each of said two laterally spaced masses comprising a shape having increasing dimensions with respect to a direction normal to and away from said vertical plane of symmetry, wherein each of said two laterally spaced masses comprises a shape which tapers rearwardly and in a direction toward each other;
  (ii) a linking portion extending between said two laterally spaced masses; and
  (iii) a generally planar front surface constituting a golf ball striking surface;

(b) a shell adapted to have a shaft extending therefrom, said shell having a front portion, said front portion of said shell having an opening for receiving and seating said elongated element, while leaving said generally planar front surface exposed; and (c) means for affixing said elongated element to said shell comprising means for directly securing at least one of (i) said laterally spaced masses and (ii) said linking portion to said shell,
wherein said masses provide an increased moment of inertia for said elongated element so as to prevent undesirable rotation of the putter head at the moment of contact with a golf ball.

17. The putter head of claim 16, wherein each of said laterally spaced masses has a depth dimension which increases downwardly and a width dimension which increases in a direction away from said plane of symmetry.

18. A golf club comprising:

(a) an element having a vertical plane of symmetry, at least two lateral portions, a linking portion extending between said two lateral portions and a front surface constituting a golf ball striking surface, each of said two lateral portions comprising a shape having an increasing dimension with respect to a direction normal to and away from said vertical plane of symmetry and a predetermined density;

(b) a shell adapted to have a shaft extending therefrom, said shell having a front portion, said front portion of said shell having an opening for receiving and seating said element, while leaving said front surface exposed, said shell comprising a material having a density lower than said predetermined density of either of said lateral portions, wherein said lateral portions provide an increased moment of inertia for said elongated element so as to prevent undesirable rotation of the golf club at the moment of contact with a golf ball; and (c) means for affixing said element to said shell comprising means for directly securing at least one of (i) said two lateral portions and (ii) said linking portion to said shell.

19. The golf club of claim 18, wherein each of said two lateral portions are formed in a shape which tapers in a direction toward each other.

20. The golf club of claim 18, wherein said element is made as a unitary piece.

21. The golf club of claim 18, further comprising a filling material located within said shell and rearward of said element.

22. The golf club of claim 18, wherein said means for affixing said element to said shell include coaxial bores formed within said element and said shell and at least one dowel fitted within said coaxial bores.

23. The golf club of claim 22, wherein said coaxial bores comprise a bore formed in each of said lateral portions, and wherein a dowel is fitted within each of said bores.

24. The golf club of claim 23, wherein said means for affixing said element to said shell further comprises means for centering said element relative to said shell.

25. The golf club of claim 24, wherein each of said lateral portions have recesses which said coaxial bores extend, wherein said shell comprises bosses through which corresponding ones of said coaxial bores extend, and wherein said means for centering said element relative to said shell comprises said bosses of said shell mating with respective ones of said recesses of said element as said element is affixed to said shell.

26. The golf club of claim 18, wherein each of said element and said shell have respective peripheries which are joined together.

27. The golf club of claim 18, wherein said element is made from sintered steel.

28. The golf club of claim 27, wherein said element further includes a quantity of a metal denser than said sintered shell which has been migrated to said sintered steel by heating.

29. The golf club of claim 28, wherein said metal is copper.

30. The golf club of claim 28, wherein said element comprises a plurality of compartments for receiving said quantity of metal.

31. The golf club of claim 30, wherein at least two of said compartments are located within said lateral portions.

32. A golf club of claim 18, further comprising said shaft connected to said shell.

33. The putter head of claim 18, said means for directly securing comprising means for directly securing said laterally spaced masses to said shell.

34. The putter head of claim 18, wherein said material of which said shell is comprised is synthetic.

35. A golf club comprising:

(a) an element having a vertical plane of symmetry, at least two lateral portions, a linking portion extending between said two lateral portions and a front surface constituting a golf ball striking surface, each of said two lateral portions comprising a shape having increasing dimensions with respect to a direction normal to and away from said vertical plane of symmetry, wherein each of said two lateral portions are formed in a shape which tapers downwardly;

(b) a shell adapted to have a shaft extending therefrom, said shell having a front portion, said front portion of said shell having an opening for receiving and seating said element, while leaving said front surface exposed; and (c) means for affixing said element to said shell comprising means for directly securing at least one of (i) said two lateral portions and (ii) said linking portion to said shell, wherein said masses provide an increased moment of inertia for said elongated element so as to prevent undesirable rotation of the golf club at the moment of contact with a golf ball.

36. The golf club of claim 35, wherein each of said two lateral portions are formed in a shape which tapers in a direction toward each other.

37. A putter head comprising:

(a) an elongated element having a vertical median plane, said elongated element comprising:

(i) two laterally spaced masses being located on either side of said vertical median plane, each of said laterally spaced masses having a shape which increases both downwardly and outwardly from said median plane;

(ii) a linking portion extending between said two laterally spaced masses; and (iii) a generally planar front surface constituting a golf ball striking surface;

(b) a shell adapted to have a shaft extending therefrom, said shell having a front portion, said front portion of said shell having an opening for receiving and seating said elongated element, while leaving said generally planar front surface exposed; and (c) means for affixing said elongated element to said shell, wherein said masses provide an increased moment of inertia for said elongated element so as to prevent undesirable rotation of the putter head at the moment of contact with a golf ball.

38. The putter head of claim 37, wherein said elongated element has a vertical plane of symmetry and said shell has a vertical plane of symmetry, wherein said means for affixing said elongated element to said shell comprises means for centering said elongated element with said shell, whereby said vertical plane of symmetry of said elongated element and said vertical plane of symmetry of said shell coincide upon said elongated element being affixed to said shell, said means for centering comprising mating portions of said elongated element cooperating with respective mating portions of said shell.

39. The putter head of claim 38, said mating portions of said elongated element and said respective mating portions of said shell of said means for centering comprising bores in each of said two laterally space masses for alignment with bores in said shell, said bores in said shell including a bore on either side of said vertical plane of symmetry of said shell extending generally vertically through a lower portion of said shell communicating with said opening of said shell.

40. The putter head of claim 37, said means for centering further comprising plugs positioned within each of said bores of said two laterally spaced masses and extending through said bores of said shell extending through said lower portion of said shell for securing said elongated element to said shell.

* * * * *